US005890549A

United States Patent [19]

Sprehe

[11] Patent Number: 5,890,549

[45] Date of Patent: Apr. 6, 1999

[54] WELL DRILLING SYSTEM WITH CLOSED CIRCULATION OF GAS DRILLING FLUID AND FIRE SUPPRESSION APPARATUS

[76] Inventor: Paul Robert Sprehe, 134 Bertel Dr., Covington, La. 70433

[21] Appl. No.: 772,697

[22] Filed: Dec. 23, 1996

[51] Int. Cl.[6] ..... E21B 21/06; A62C 35/68

[52] U.S. Cl. ..... 175/71; 169/69; 175/88; 175/206

[58] Field of Search ..... 175/71, 88, 206, 175/209, 212, 205, 207, 208; 166/90.1; 169/69

[56] References Cited

U.S. PATENT DOCUMENTS

| | | | |
|---|---|---|---|
| 1,847,864 | 3/1932 | Cross | 175/88 X |
| 3,417,830 | 12/1968 | Nichols | 175/209 |
| 4,316,506 | 2/1982 | Poole | 169/69 |
| 4,363,357 | 12/1982 | Hunter | 175/209 X |
| 4,899,827 | 2/1990 | Poole | 169/69 |
| 5,775,442 | 7/1998 | Speed | 175/212 X |

OTHER PUBLICATIONS

"Electronic pressure Detection Improves Drilling Operations," Condon, William S. et al. World Oil, Mar. 1996 (best available copy).

Williams Tool Co., Inc. product data, Rotating Blowout Preventer Systems, date unkown.

"Underbalanced Drilling With Air Offers Many Pluses", Shale, Les, Oil & Gas Journal, pp. 33–39, Jun. 26, 1995.

"Applications widening for rotating control heads", Hannegan, Don, Drilling Contractor, pp. 17–19, Jul. 1996.

"Rotating control head applications increasing", Bourgoyne, Jr., Adam T., Louisiana State University, Oil and Gas Journal, Oct. 9, 1995.

"Rotating preventers: Technology for better well control", Tangedahl, Michael J.; Stone, Charles R. (Rick), World Oil, pp. 63–64, 66, Oct. 1992.

"Properly designed underbalanced drilling fluids can limit formation damage", Churcher, P.L.; Yurkiw, Fred J.; Bietz, Ron F.; Bennion, D. Brant; pp. 50–56, Oil & Gas Journal, Apr. 29, 1996.

"Monitoring downhole pressures and flow rates critical for underbalanced drilling", Butler, S.D.; Rashid, A.U.; Teichrob, R.R., Oil & Gas Journal, pp. 31–39, Sep. 16, 1996.

"Air and Gas Drilling", Nicolson, K.M., Standard Oil Company of California publication, pp. 149–155, date unknown.

(List continued on next page.)

*Primary Examiner*—David J. Bagnell
*Attorney, Agent, or Firm*—Akin, Gump, Strauss, Hauer & Feld, L.L.P.

[57] ABSTRACT

A well drilling system for drilling with gaseous drilling fluid, particularly natural gas, in a closed circulation path including an enclosure or bell nipple mounted on a wellhead between the wellbore and a rotary control head for the drillstem. The enclosure redirects the flow of cuttings laden gaseous drilling fluid being circulated out of the well and includes a plurality of fire extinguishing fluid injection nozzles arranged to inhibit or extinguish fire within the enclosure and the rotary control head. Drill cuttings are separated from the gaseous drilling fluid in a pressure vessel which includes separator baffles and a drill cuttings port and valve arrangement for dumping samples and substantial quantities of drill cuttings collected within the pressure vessel during operation of the system. The enclosure and fire extinguishing system may be used in conjunction with operations using conventional liquid drilling fluids and conventional liquid-solids separation equipment. Methods for monitoring pressure surges in the wellbore to control or minimize deviation from a predetermined pressure condition included monitoring fluid flow rate and pressures of drilling fluid flowing into and from the well and controlling the rate of insertion of a drillstem into the well to minimize pressure surges.

33 Claims, 6 Drawing Sheets

OTHER PUBLICATIONS

Drilling applications expand snubbing unit use, Lagendyk, R.; Loring, G. and Aasen, J., pp. 37–44, World Oil, May 1996.

Strong growth projected for underbalanced drilling, Duda, John R., Oil & Gas Journal Special, pp. 67–77, Sep. 23, 1996.

Recent Advances in Underbalanced Horizontal Drilling, Yee, Stewart; Comeaus, B. and Smith, R., Sperry–Sun Drilling Services, pp. 1–7, 9 Figures, copyright, 1995.

WELL DRILLING SYSTEM WITH CLOSED CIRCULATION OF GAS DRILLING FLUID AND FIRE SUPPRESSION APPARATUS

FIELD OF THE INVENTION

The present invention pertains to well drilling systems and methods which include closed circulation of gaseous drilling fluid, including drill cuttings separation apparatus, and further including fire suppression methods and a fire suppression apparatus disposed at the wellhead. Embodiments of the system provide for improved underbalanced drilling using natural gas as a drilling fluid.

BACKGROUND

The substantial and continuous efforts to recover hydrocarbon fluids from underground reservoirs has brought on the realization that subterranean earth formation damage, which reduces hydrocarbon fluid recovery, can occur through the use of conventional liquid drilling fluids, such as so-called drilling muds. These fluids, which usually comprise water or refined hydrocarbon liquids, a weighting agent, viscosifiers and lost circulation prevention substances, can invade the formation from the wellbore while circulating the fluids during the drilling process and resulting in damage to the formation with respect to efforts to recover hydrocarbon fluids therefrom. Penetration of drilling fluids into the formation occurs, of course, when the pressure forces of the fluids in the well exceed the natural formation pressure. However, conventional drilling techniques include maintaining a so-called overbalanced or net positive pressure of the drilling fluid over and above the formation pressure to minimize contamination of the drilling fluid with formation fluids and to minimize the chance of well blowout.

Efforts to overcome the potential for damage created by drilling with conventional liquid drilling fluids or muds in overbalanced conditions have resulted in the development of so called underbalanced drilling techniques wherein the hydrostatic pressure of the drilling fluid in the well is maintained at a value less than the formation pressure to minimize penetration of the drilling fluids into the formation from the wellbore wall interface. Still further, where formation conditions permit, drilling operations have been carried out with compressed air, natural gas and other gasses as the drilling fluid. When environmental and economic conditions permitted the use of natural gas as a drilling fluid in a so-called open circulation system, this technique was widely used. However, the commercial value of natural gas and environmental considerations have resulted in substantial elimination of drilling operations wherein natural gas is used as the circulation fluid but is vented to atmosphere or "flared" after returning from the borehole with entrained drill cuttings.

Drilling with compressed air as the cuttings evacuation fluid also tends to oxidize formation fluids in situ and raise the hazard of ignition of formation produced combustible gasses, such as natural gas, when mixed with the compressed air in the circulation system. Moreover, heretofore, other problems associated with operating a closed gas circulation system for well drilling have prevented use of these systems with inert gas or compressed air.

Use of natural gas as the cuttings evacuation fluid, in particular, in a well drilling system, has certain advantages in underbalanced operating conditions. Natural gas is often in plentiful supply in hydrocarbon reservoirs and nearby formations and may be a product of the reservoir itself in many formations. The use of natural gas as a drilling fluid reduces the hazards of operating in an overbalanced condition because the gas minimizes formation damage in liquid hydrocarbon as well as hydrocarbon gas producing or storage reservoirs and, in fact, can enhance formation productivity through its miscibility with formation liquids and its effectiveness as a drive fluid.

Moreover, drilling operations carried out in so called underbalanced or substantially underbalanced pressure conditions in the wellbore can possibly bring about the realization of as much as a 10-fold increase in the rate of penetration in geo pressured reservoirs and hard rock formations such as hard sand, dolomite and limestones. This increase in the rate of penetration is accomplished due to the fact that earth formations are much weaker in tension than in compression. Accordingly, by reducing wellbore pressures which would place the formation in compression at the point of penetration of the formation these dramatic increases in the rates of penetration may be realized, particularly with a closed gas drilling fluid circulation system.

However, a closed gas circulation system presents certain problems, including drill cuttings separation and sampling from the gas circulation system, treatment of the gas so that it is suitable for recirculation through the drill string and the wellbore or discharge to a gas transport pipeline, and well control to prevent unwanted blowouts or fire resulting from the presence of a combustible fluid. These problems have been substantially overcome by the present invention as will be appreciated by those skilled in the art from reading the following summary and a detailed description of the system, its components and methods of operation in accordance with the invention.

SUMMARY OF THE INVENTION

The present invention provides an improved drilling system for drilling wellbores into earth formations, particularly formations capable of producing hydrocarbon fluids. The present invention also provides a drilling system having means for closed circulation of a gaseous drilling fluid, particularly natural gas as such drilling fluid.

The present invention further provides a gaseous drilling fluid circulation system which includes a unique gas-liquids-drill cuttings separation system including a drill cuttings recovery and sampling apparatus.

The present invention still further provides a drilling system having improved fire suppression and control means to inhibit ignition of an uncontrolled oil or gas flowstream from a well, extinguish a burning well should ignition occur and cool the well flowstream and equipment following extinguishment of a fire. The system may be advantageously used with gaseous drilling fluid and other types of drilling fluids, including foams and conventional liquid drilling fluids or so called drilling muds.

In accordance with one aspect of the present invention, a drilling system for drilling into a subterranean earth formation is provided which includes an arrangement of components adapted for closed circulation of gaseous drilling fluid, particularly natural gas, for example. The closed circulation system includes a unique fluid-solids separation apparatus comprising a closed vessel for separating and recovering drill cuttings and for sampling the composition of the drill cuttings at selected intervals.

In accordance with another aspect of the invention, a drilling system is provided which includes fire suppression means comprising an enclosure at the wellhead for redirecting the flow of drill cuttings entrained with a drilling fluid, which enclosure is provided with an array of fire extinguishing fluid injection nozzles. In accordance with a further aspect of the present invention, a fire extinguishing or suppression enclosure is disposed in a wellhead structure which may include a rotary blowout preventer or head member for a closed drilling fluid circulation system, particularly a gaseous drilling fluid circulation system. The fire extinguishing and fire prevention enclosure and system may also be used with open, liquid drilling fluid circulation systems.

In accordance with still another aspect of the present invention, a method and system are provided for drilling a well with drilling fluid in an underbalanced working pressure condition. The method of the invention contemplates closed circulation of a pressure gaseous drilling fluid including separation of drill cuttings, and distribution or recompression and recirculation of the fluid.

The present invention also provides a method which advantageously compares the flow rate of drilling fluid returning from the wellbore with the flow rate of drilling fluid entering the wellbore and the pressure of fluid entering the wellbore to detect pressure surges, a potential well blowout condition and/or lost circulation. A drilling method is also contemplated wherein a predetermined pressure change in the pressure of fluid standing in the wellbore annulus is compared with actual pressure surge resulting from movement of drill pipe into and out of the wellbore and wherein the rate of drill pipe movement into and out of the wellbore is controlled to prevent more than a predetermined change of drilling fluid hydrostatic pressure within the wellbore.

Those skilled in the art will further appreciate the above-mentioned advantages and superior features of the invention together with other important aspects thereof upon reading the detailed description which follows in conjunction with the drawing.

DESCRIPTION OF THE PREFERRED EMBODIMENTS

Figure 1:
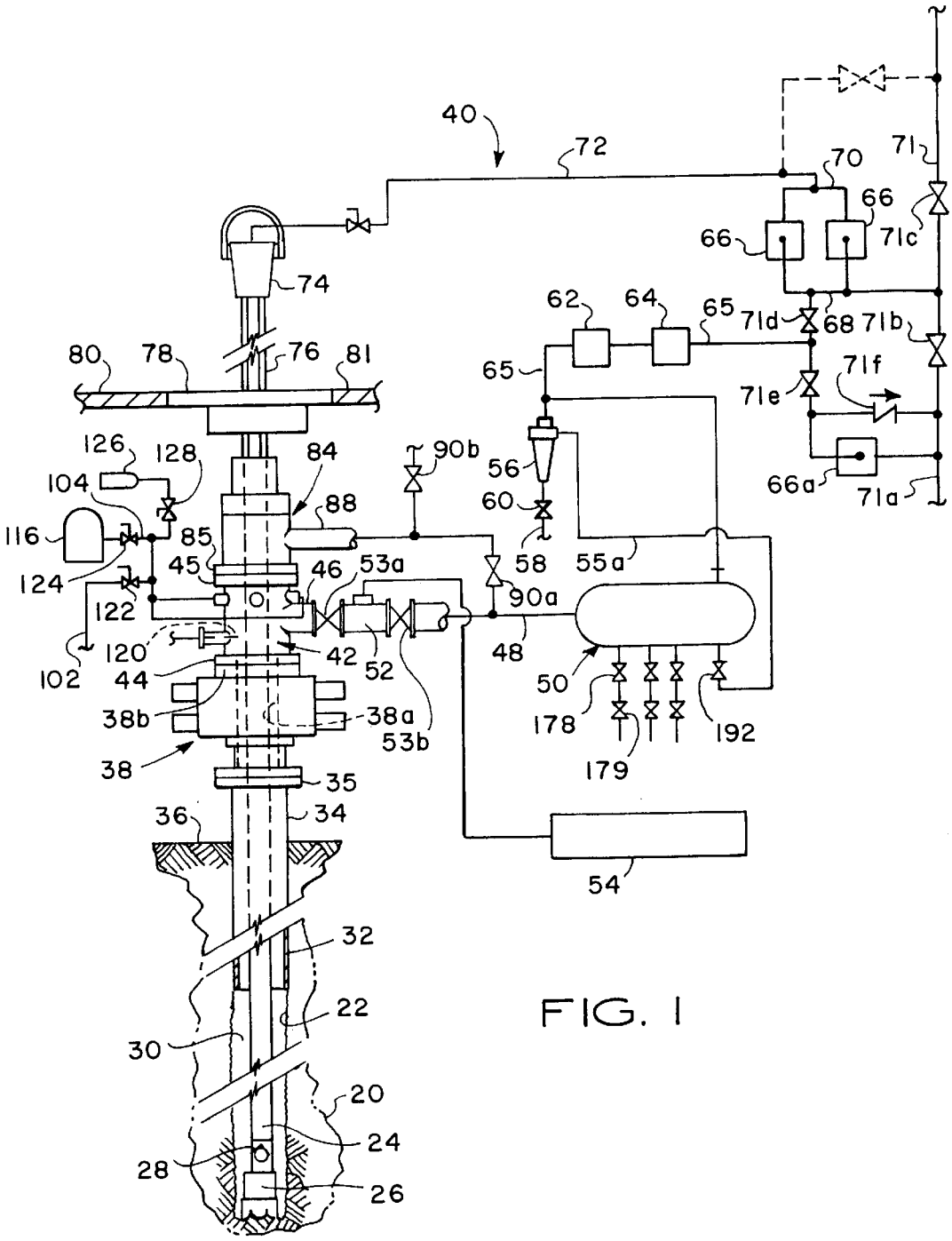
FIG. 1 is an elevation, in somewhat schematic form, of a well drilling system in accordance with the present invention.

In the description which follows, like elements are marked throughout the specification and drawing with the same reference numerals, respectively. The drawings are not necessarily to scale and many elements are shown in somewhat generalized or schematic form in the interest of clarity and conciseness.

Referring to FIG. 1, there is illustrated in somewhat schematic form a system for drilling a well in an earth formation 20 which is being penetrated by a wellbore 22. Wellbore 22 may be formed by a conventional rotary drilling apparatus, not shown, including an elongated sectional drillstem 24 having a conventional rotary drillbit 26 connected to the lower distal end thereof. A suitable one-way valve or so-called check valve 28 is disposed in the drillstem to allow conduction of drill cuttings evacuation fluid through the drillstem, out through suitable ports in the bit 26 and up through the wellbore annulus 30. The drillstem 24 extends through a suitable casing 32 above the open hole portion of the wellbore 22 shown, which casing extends upward and includes a surface casing portion 34 of conventional construction. The surface casing 34 extends somewhat above the earth's surface 36 at the point of entry of the wellbore 22 and has supported thereon a conventional blowout preventer apparatus, generally designated by numeral 38. The apparatus 38 may or may not be present in a well drilling operation using the system of the invention.

The drilling system of the invention is illustrated in FIG. 1, is generally designated by the numeral 40, and is adapted to carry out drilling of the wellbore 22 to a selected depth by using a gaseous drilling fluid, preferably natural gas. Use of natural gas as the drilling fluid for evacuating drill cuttings from the wellbore 22 up through the casings 32 and 34 is advantageous in that, in many well drilling operations to recover hydrocarbon fluids, a plentiful supply of natural gas is available. More importantly, perhaps, use of natural gas as the drilling fluid minimizes formation damage to the earth formation 20.

The drilling system 40 is adapted to include components which may be supported on the blowout preventer 38 or mounted directly on a flange 35 of the surface casing 34. One of the important elements of the drilling system 40 is a generally cylindrical tubular enclosure member for controlling and diverting flow of cuttings laden drilling fluid which is exiting the wellbore through the surface casing 34 and suitable passage means 38*a* in the blowout preventer 38. This enclosure member, sometimes called a bell nipple, is a generally cylindrical tubular member 42 having a lower transverse flange 44 which is adapted to be mounted on a cooperating flange 38*b* of the blowout preventer 38. A conventional restabbing flange 45 is connected to and forms part of enclosure 42 and is spaced from flange 44.

The enclosure member 42 of the present invention includes a transversely extending discharge conduit section 46 which is connected to suitable conduit means 48 leading to a cuttings separation and storage apparatus, generally designated by the numeral 50. A fluid flowmeter 52 is interposed in the conduit 48 between the enclosure member 42 and the apparatus 50 and is connected to a suitable control and recording system 54 for recording flow rates of drilling fluid and any fluids which may enter the wellbore 22 from the earth formation 20 during drilling thereof. Suitable control valves 53*a* and 53*b* are interposed in conduit 46, as shown. By way of example, the flowmeter 52 may be of an ultrasonic type commercially available such as a gas flowmeter sold under the trademark UltraTap by Daniel Flow Products, Inc., Houston, Tex., or a type available from Alphasonics, Inc., Austin, Tex., as their model Alpha 5000.

Gas drilling fluid separated from drill cuttings in the apparatus 50 then flows by way of a conduit 55 directly to a series of gas dehydration and gas-liquids separation devices, indicated generally by numerals 62 and 64. A flowstream of gas and entrained liquid and/or solids fines may also leave the apparatus 50 by way of a conduit 55*a* which is connected to a separator 56 whereupon any liquids and/or solids fines are separated from the gas flowstream. Substantially solids free gas exits the separator 56 by way of a conduit 65 which is also connected to the conduit 55 and to a gas dehydrator 62 and a final liquids separator or trap 64. Accordingly, two flowstreams of gaseous drilling fluid may leave the apparatus 50, and particulate solids as well as some liquids are retained in the apparatus 50 and are eventually removed therefrom, as will be described in further detail herein. Separator 56 is provided with a suitable conduit 58 having a control valve 60 interposed therein wherein solids fines and liquids may be periodically or continuously discharged from the separator 56. The separator 56 may be of a centrifugal type, as indicated by the schematic illustration in FIG. 1.

Conduit 65 is operable to be connected to a manifold 68 which is operable to recirculate gas to and through gas compressors 66, two shown connected in parallel relationship, by way of example. Compressors 66 discharge pressure gas to a manifold 70 which is connected to a fluid return line 72 through which gas flows to a conventional rotary swivel 74 connected to the upper end of the drillstem 24. The upper end of the drillstem 24, in the exemplary embodiment shown in FIG. 1, includes a conventional rotary drive member or so-called kelly 76. Gaseous drilling fluid may also be supplied to the manifold 68 by a gas gathering, distribution or so-called sales transport pipeline 71 operably connected to the manifold 68, as shown. Pressure gas from line 71 may be supplied directly to return line 72, as indicated in FIG. 1, if pressure in line 71 is sufficient. Gas treated by the system 40 and being discharged through the conduit 65 may be returned to a transport pipeline 71*a* which may be connected to pipeline 71 through suitable valves 71*b* and 71*c*. Control valves 71*d*, 71*e* and 71*f* are operable to control the flow of gas from the conduit 65 to the pipeline 71*a* or to the manifold 68 in a selected manner. Moreover, returning processed gas from conduit 65 to pipeline 71*a* may require compression by a suitable compressor 66*a*. Accordingly, gas may be introduced into the closed circulation system from pipeline 71 either directly or by way of valve 71*c*, manifold 68 and compressors 66. Gas may be returned to a pipeline 71*a* from conduit 65 by way of valve 71*e* and either compressor 66*a* or a conduit section in which check valve 71*f* is interposed. Of course, gas may be recirculated from conduit 65 to compressors 66 by way of valve 71*d* and manifold 68. Valves 71*b*, 71*c*, 71*d* and 71*e* are appropriately positioned to allow the gas flow paths described above.

The kelly 76 extends through a conventional rotary table 78 supported on a portion of a drilling rig 80. Conventional elements such as a rig derrick and a drawworks operably connected to the swivel 74 through a suitable hoist cable and hook assembly are not shown and described in the interest of clarity and conciseness.

Those skilled in the art will recognize that the system of the present invention need not require drilling by a conventional rotary table driven rotary drillstem. The drilling apparatus may include a so-called top drive apparatus, not shown, in place of the swivel 74. The lower end of the drillstem 24 may also include, in place of the rotary bit 26, a percussion type drilling tool or hammer of a type commercially available, also not shown. The drilling operation may also be carried out with a hydraulic workover rig or with coilable tubing as the drillstem while otherwise using the system and method of the invention. The wellbore 22 need not be vertical and the wellbore may slant or may actually extend in a substantially horizontal direction over at least a portion thereof.

The drilling system 40 also utilizes a commercially available, so-called rotary blowout preventer or control head, disposed between the rotary table 78 (or a top drive or other connection between the drillstem and the aforementioned hoisting apparatus) and the enclosure member 42. One embodiment of a rotary control head or blowout preventer used in the present invention is generally designated by the numeral 84 and is suitably mounted on flange 45 of the enclosure 42. The rotary head 84 may be of a type commercially available. One preferred type for use with the system 40 is manufactured by Williams Tool Company, Inc. of Fort Smith, Ark. as their Model 7000 or 9000 Series Rotating Control Head. The rotary head 84 also includes a secondary fluid discharge flowline 88 extending therefrom for conducting pressure fluid from the wellbore 22 and the rotary head. However, under normal operating conditions of the system 40, all drill cuttings and drill cuttings evacuation fluid flowing from the wellbore passes through the enclosure 42 and its branch conduit 46 for flow through the conduit 48 to the separation apparatus 50. Suitable valves 90*a* and 90*b* are interposed in the branch conduit 88 and may be operated to allow fluid to flow through this conduit to apparatus 50 or to a cuttings disposal pit, not shown, under selected operating conditions.

Operation of the drilling system 40 may be carried out by filling or "charging" the fluid passages of the system, including the drillstem 24, the wellbore annulus 30, the enclosure 42, the conduit 46, 48, the pressure vessel comprising the apparatus 50, the conduits 55, 55*a* and 65 and the elements interposed therein, the compressors 66, the manifold 70 and flowline 72 with pressure gas. This gas may be drawn from the gas gathering or so-called gas sales pipelines 71 and/or 71*a* and, during drilling, any excess gas in the system may be subject to controlled discharge into the lines 71 or 71*a*. On startup of one or both of the compressors 66, pressure gas is communicated by way of manifold 70, return line 72 and down through the hollow drillstem 24 by way of the swivel 74 in a conventional manner for discharge into the wellbore annulus while drilling operations are carried out. Pressure gas discharged from bit 26 into the wellbore 22 entrains drill cuttings therein and conveys the cutting up the annulus 30, through enclosure 42 and then to apparatus 50. Gas may be recirculated through the system 40, or drawn from pipeline 71 and returned to pipeline 71*a*, while drill cuttings solids and any formation liquids or foam injected into the gas flowstream are separated from the gas flowstream in the apparatus 50, 56, 62 and 64.

The separator apparatus 50 may also be adapted to separate liquids as well as solids fines from the gas flowstream entering the apparatus by way of conduit 55*a*. Accordingly, in drilling operations wherein only relatively large solids particulate drill cuttings are being generated, the conduit 55*a* and separator apparatus 56 may be omitted or shut off and substantially solids free gas may be conducted from the apparatus 50 directly through conduit 55 to the gas dehydrator 62 and liquids trap 64.

However, if relatively large quantities of formation fluids in liquid form are being generated or gases of densities different than the gaseous drilling fluid are being generated, these fluids may be separated along with formation fines, if generated, in the separator 56 and substantially liquid and solids-free gas conducted from the separator 56 by way of conduit 65 and the treatment devices 62 and 64 to the compressors 66. The separator device 56 may be a multistage separator of a type necessary to provide three phase separation, that is separating the gaseous drilling fluid from liquids and solids entrained therein and, possibly even separation of gasses of different densities from the gaseous drilling fluid.

Drilling operations are preferably carried out in underbalanced conditions with the closed gas circulation system described above to minimize loss of gas into the earth formation 20. However, gas entering the formation will do minimal damage and may, in fact, eventually enhance the production of hydrocarbon fluids from a desired production zone. Typically, wells up to 10,000 feet to 15,000 feet deep may be drilled using a closed gas circulation system of the present invention for evacuating drill cuttings from the wellbore 22. One advantage of the system 40 described herein is that the risk of downhole ignition of natural gas, when used as a drilling fluid, is substantially eliminated as compared to the use of compressed air as the drilling fluid. The likelihood of a combustible mixture developing during drilling operations is actually greater with the use of compressed air as the drilling fluid in the event of invasion of hydrocarbon gases into the wellbore during drilling operations, particularly when drilling in an underbalanced condition.

However, with the wellbore annulus 30 and the closed gas circulation system described herein substantially devoid of oxygen during drilling operations, the likelihood of an explosive mixture developing within the closed gas circulation system is virtually eliminated. Working pressures and flow volumes of gas used in drilling will, of course, depend on the diameter of the wellhole 22, the depth of the wellbore and the rate of cuttings evacuation, required. Working parameters used for drilling with compressed air as the drill cuttings fluid may be utilized for determining the operating conditions with natural gas as the drill cuttings evacuation fluid with appropriate compensation for fluid density, for example.

Although the likelihood of combustion of gas in the fluid circulation system described hereinabove is minimal, the enclosure 42 is adapted to provide for (1) extinguishing any fires which may develop in the enclosure or the blowout preventer 38 or the wellbore annulus 30 and progress to the enclosure and (2) inhibiting the ignition of a stream of well fluids, liquids and/or gas flowing there through. The enclosure 42 is provided with an array of fire extinguishing fluid injection nozzles, which are operable to be connected to a source of fire extinguishing fluid, such as a fine particulate chemical type which is conveyed by an inert compressed gas and injected into the interior of the enclosure 42 to, particularly, prevent fire destruction of the rotary control head 84; the entire drilling rig and any environmental degradation resulting from such fire. Water may also be injected into enclosure 42 to inhibit ignition, extinguish a fire and act as a cooling medium after fire extinguishment.

Figure 2:
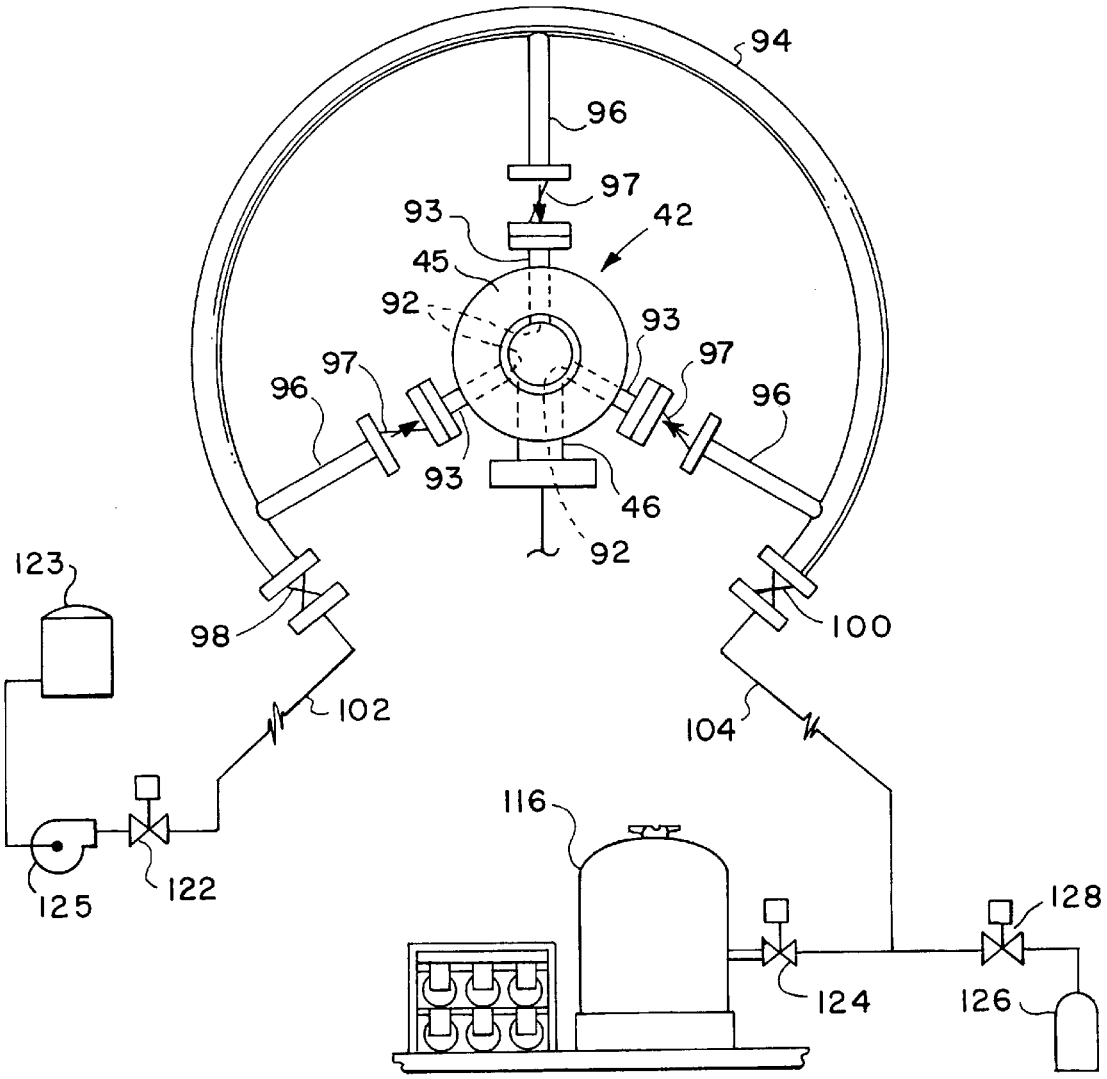
FIG. 2 is a schematic plan view of a drilling fluid flow diverting enclosure or nipple showing a preferred arrangement of injection nozzles for fire extinguishing fluids.
Figure 3:
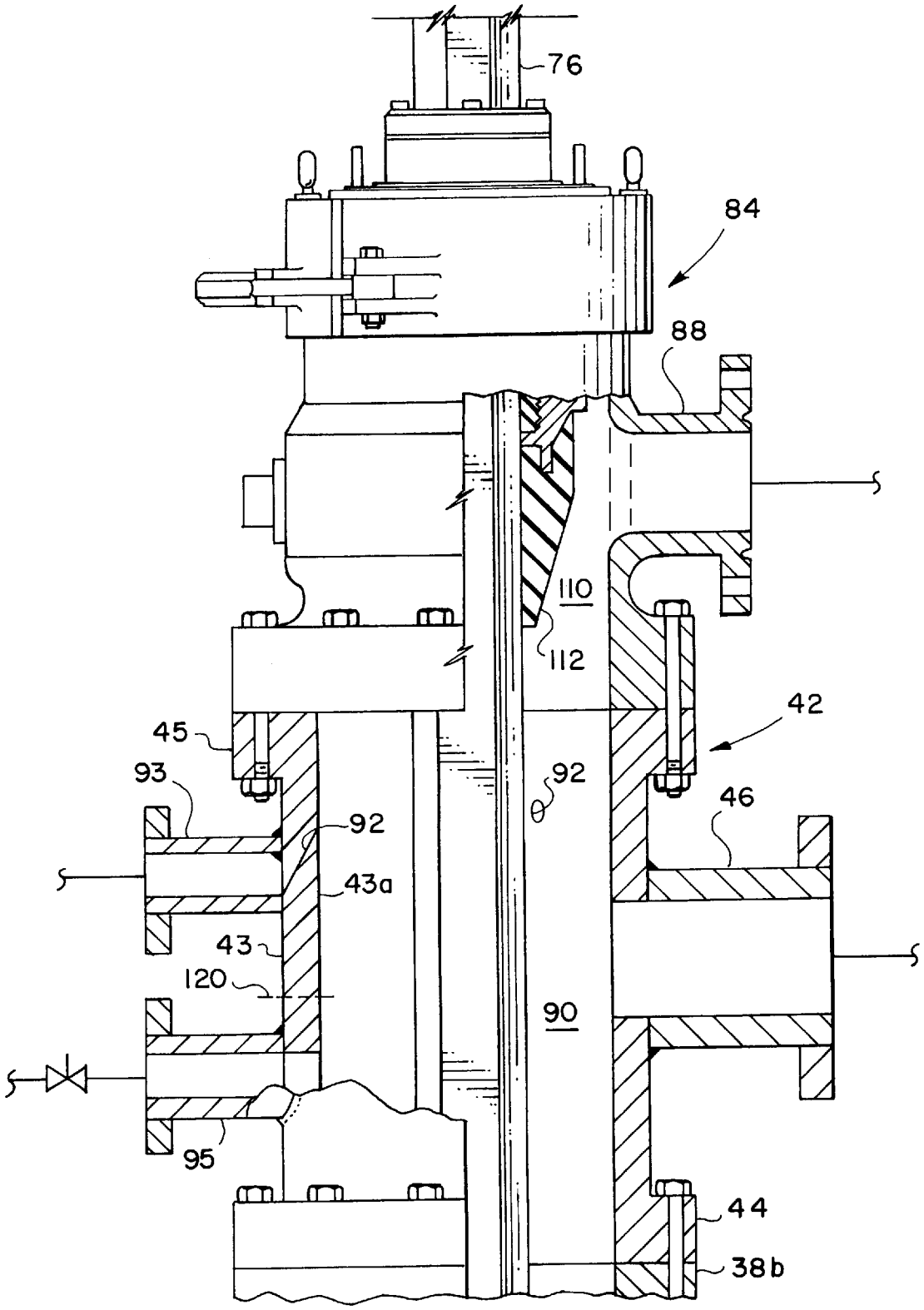
FIG. 3 is a vertical, central section view of the drilling fluid flow diverting enclosure and a rotary control head or blowout preventer arrangement in accordance with the invention.

Referring now to FIGS. 2 and 3, and FIG. 3 in particular, the enclosure 42 includes a generally cylindrical wall 43 extending between the flanges 44 and 45, of a suitable thickness and of a suitable material, together with the flanges, to meet system pressure and fire rating requirements. As shown in FIG. 3, an interior space 90 is provided within the enclosure 42, as defined by the wall 43, and at least three fire extinguishing fluid injection nozzles 92, two shown in FIG. 3, are arranged, preferably equally spaced about the circumference of the enclosure, as shown. The convergent nozzles 92 are oriented to inject fire extinguishing or suppression fluid toward the head 84, preferably intersect the inside surface 43*a* of wall 43 at an angle of about 30° and are in communication with respective radially projecting circumferentially spaced apart tubular bosses 93 on the exterior of the enclosure 42, as shown in FIG. 2. The nozzles 92 may be disposed at other angles, including 90°, with respect to wall surface 43*a*. A suitable branch conduit 95, FIG. 3, also opens into space 90 for ancillary purposes, such as filling annulus 30 with a kill fluid, for example.

A suitable arcuate manifold 94, FIG. 2, is provided extending partially around enclosure 42 and is preferably characterized by a flexible steel hose or pipe, such as a type made by Coflexip, Houston, Tex. Branch conduits 96 extend from the manifold 94 to respective block valve and check valve 97 assemblies which are connected to the respective bosses 93 arranged in the pattern shown in FIG. 2. Opposite ends of the manifold 94 are connected to suitable valves 98 and 100 which are, respectively, in communication with a water supply conduit 102 and a fluidized dry chemical fire extinguishing composition supply conduit 104.

As further shown in FIG. 3, the control head 84 includes an interior chamber 110 in communication with the space 90 and the discharge conduit 88. The control head may also be of a type not having a fluid discharge flow path such as provided by the conduit 88. An annular seal member 112 is disposed in chamber 110 and sealingly engages the kelly 76 in a known way. Accordingly, fire erupting within or which may progress to the chamber or space 90 may be extinguished or suppressed by injection of a mixture of fine particulate fire extinguishing material, such as potassium bicarbonate, conveyed into the interior of the enclosure or nipple 42 by way of the injection nozzles 92. The nozzles 92 are desirably oriented for discharging fire extinguishing material directly at the seal member 112 to minimize any tendency for this member to be destroyed by fire or, in the event of catastrophic failure of the seal member, to extinguish or inhibit fire in any stream of combustible fluid flowing through the control head 84 and under or onto the floor 81 of drilling rig 80.

Referring further to FIGS. 1 and 2, fire extinguishing fluid is supplied to the supply conduit 104 from a suitable reservoir 116 which may be characterized by a conventional dry chemical fire extinguishing unit, such as a type supplied by Ansul Fire Protection Division of Wormald U.S., Inc., Marinette, Wis., as one of their skid mounted dry chemical systems of the S-3000 series, for example. These systems are capable of discharging substantial quantities of fluidized fire extinguishing material, such as particulate potassium bicarbonate, entrained in a nitrogen gas flowstream. As shown in FIG. 1 also, the enclosure 42 may include a suitable pressure and/or temperature sensor 120 operably connected to the controller 54 for sensing pressure and temperature conditions in the enclosure to effect operation of controller 54 to cause the reservoir 116 to discharge a pressure flowstream of fire extinguishing chemical or water into the space 90 through the injection nozzles 92. Suitable remote controlled valves 122 and 124 are interposed in the conduits 102 and 104 upstream of the valves 98 and 100, not shown in FIG. 1, for controlling the flow of fire extinguishing fluids to the enclosure 42. A small reservoir 126 of fire extinguishing fluid may be connected to the manifold 94 by way of a suitable control valve 128, as shown in FIG. 1 and 2, for testing operability of the system, from time to time. As shown in FIG. 2, a water reservoir 123 and pump 125 are connected to conduit 102 by way of control valve 122.

Typical dimensions for the enclosure 42 comprise a forged steel cylindrical wall or spool portion 43 of about 10.0 inches diameter, an overall length of about 24.0 inches to 45.0 inches and a drilling fluid return flow or branch conduit 46 having a nominal diameter of about 6.0 inches. Nozzles 92 have a nominal diameter of about 2.0 inches at their inlet ends and about 0.25 inches at their outlet ends. The pressure rating of the enclosure 42 should be comparable to that of the blowout preventer 38, for example, and the control head 84. Typical working pressures for gas drilling fluid in a closed gas circulation system for drilling a wellbore of about 8.5 inches diameter, using 3.5 inch to 4.0 inch diameter drill pipe, are in the range of about 2500 psig, for example.

The quantities of fire extinguishing fluids including those available from both conduits 102 and 104 and the flow rates of fluids required for prevention or extinguishment of a fire may be based on a method for predicting physical damage resulting from a fire erupting at the wellhead of a particular well. For example, the operational capacities of the fire inhibition and extinguishment system of the invention may be predetermined based on a method for anticipating the quantity of fluid flowing from the well (based on reservoir conditions and well dimensional characteristics), the forces that will likely exist at the point of well blowout, the velocity profile of the well stream components, the impingement arc of the blowing well stream based on the velocity profile overlaid on drawings of the drilling rig substructure or production platform, the combustion profile of the components of a well stream that are likely to be burning in the impingement arc, the temperature profile of the burning well stream adjusted for a prevailing wind condition and a drainage profile of the portion of the well stream not likely to be burning, which profile may be overlaid on elevation maps of a drill rig, platform, ocean current profile and terrain topography. At least certain ones of these factors would be used in determining the dimensions of the enclosure 42 as well as the expected flow rates and volumes of fire extinguishing fluids required for delivery to and through the enclosure 42.

Figures 4, 5:
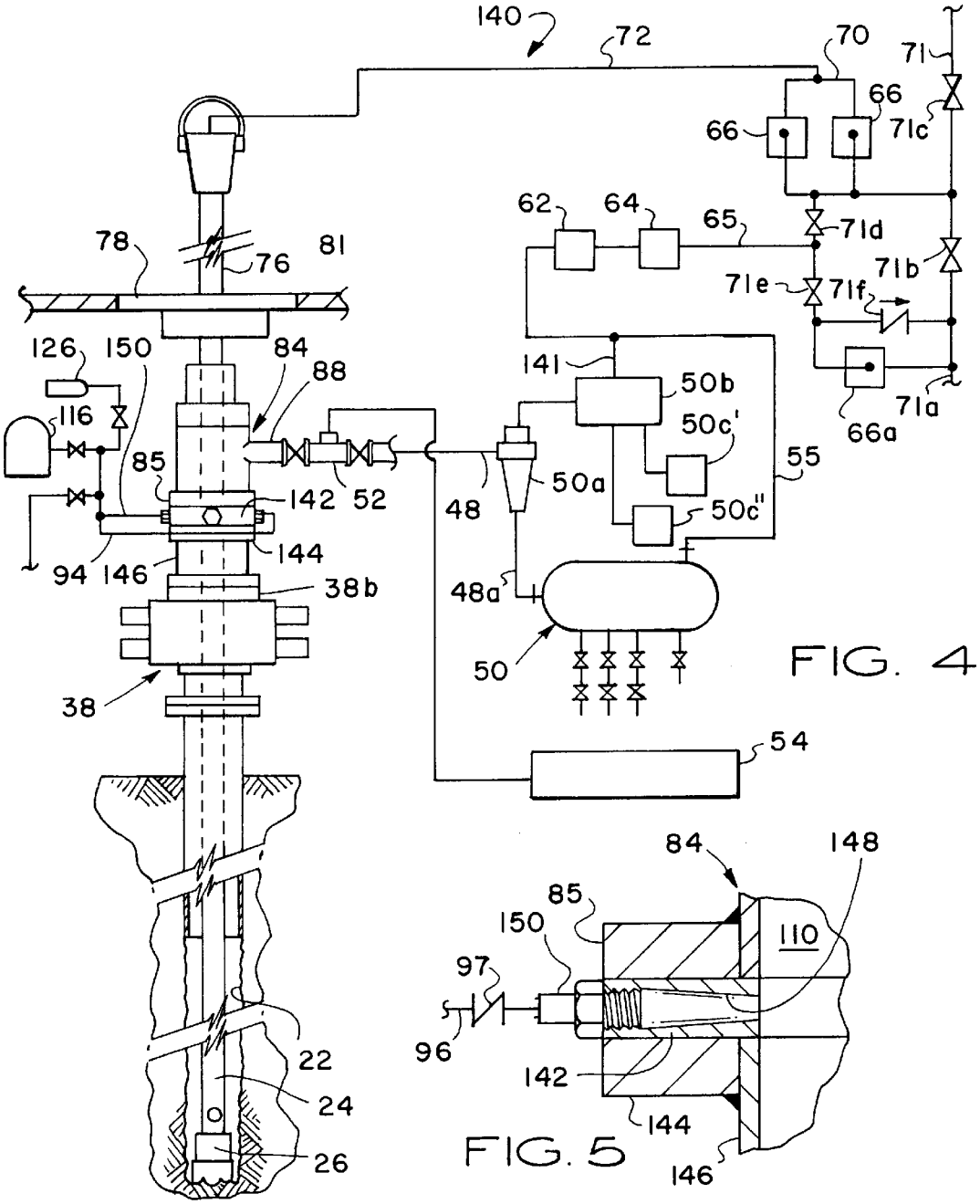
FIG. 4 is an elevation, in generally schematic form, of a modified drilling system and fire extinguishing fluid injection system.
FIG. 5 is a detail section view of one of the fire extinguishing fluid injection nozzles in the arrangement of FIG. 4.

Referring briefly to FIGS. 4 and 5, a modified drilling system in accordance with the invention is illustrated and generally designated by the numeral 140. The drilling system 140 is similar to the system 40 with one exception being that the enclosure 42 is replaced by a generally circular flange 142 which may be disposed between connecting flange 85 on the rotary control head 84 and a mating flange 144 of a short section of riser or spool 146 disposed between the flange 142 and the outlet flange 38*b* of blowout preventer 38, as shown in FIG. 4. As shown in FIG. 5, the flange 142 is provided with plural spaced apart convergent nozzles 148, one shown, which are each connected to a fitting 150 operable to be connected to the manifold 94 by way of a check valve 97 and conduit 96 whereby fire suppression or extinguishing material may be injected into the interior chamber 110 of the rotary control head 84, when needed. In the drilling system 140, the primary drill cuttings fluid return conduit is the branch conduit 88 of the rotating control head 84 and is of a suitable diameter to handle the flowstream of cuttings laden drilling fluid. A flowmeter 52 is connected to the conduit 88 and drill cuttings are conveyed through conduit 48 from the conduit 88 to separator apparatus described hereinbelow.

The drilling system 140 is also adapted to include somewhat more elaborate separation of drilling fluid from both liquids and solids entrained therein and wherein the flow of solids drill cuttings may be substantial. In this regard, a centrifugal separator 50*a* is connected to conduit 48 for separating gas and solids from the cuttings evacuation fluid flowstream and wherein a gas-solids mixture is then conducted to the separator apparatus 50 while liquids and some gas are conducted to a further separator 50*b*, primarily comprising means for separating gas from liquid and separating liquids of different densities. Liquids, such as oil and water, are separated from gas in the separator 50*b* and may be separated from each other and stored in suitable tanks 50*c*' and 50*c*", while substantially liquid-free gas may be conducted by way of a conduit 141 to the devices 62 and 64 and then by way of conduit 65 to the compressors 66 or pipeline 71*a*. Gas and solids are separated in the apparatus 50 and substantially solids free gas is conducted by way of a conduit 55 to the devices 62 and 64 and conduit 65, as illustrated.

Figure 6:
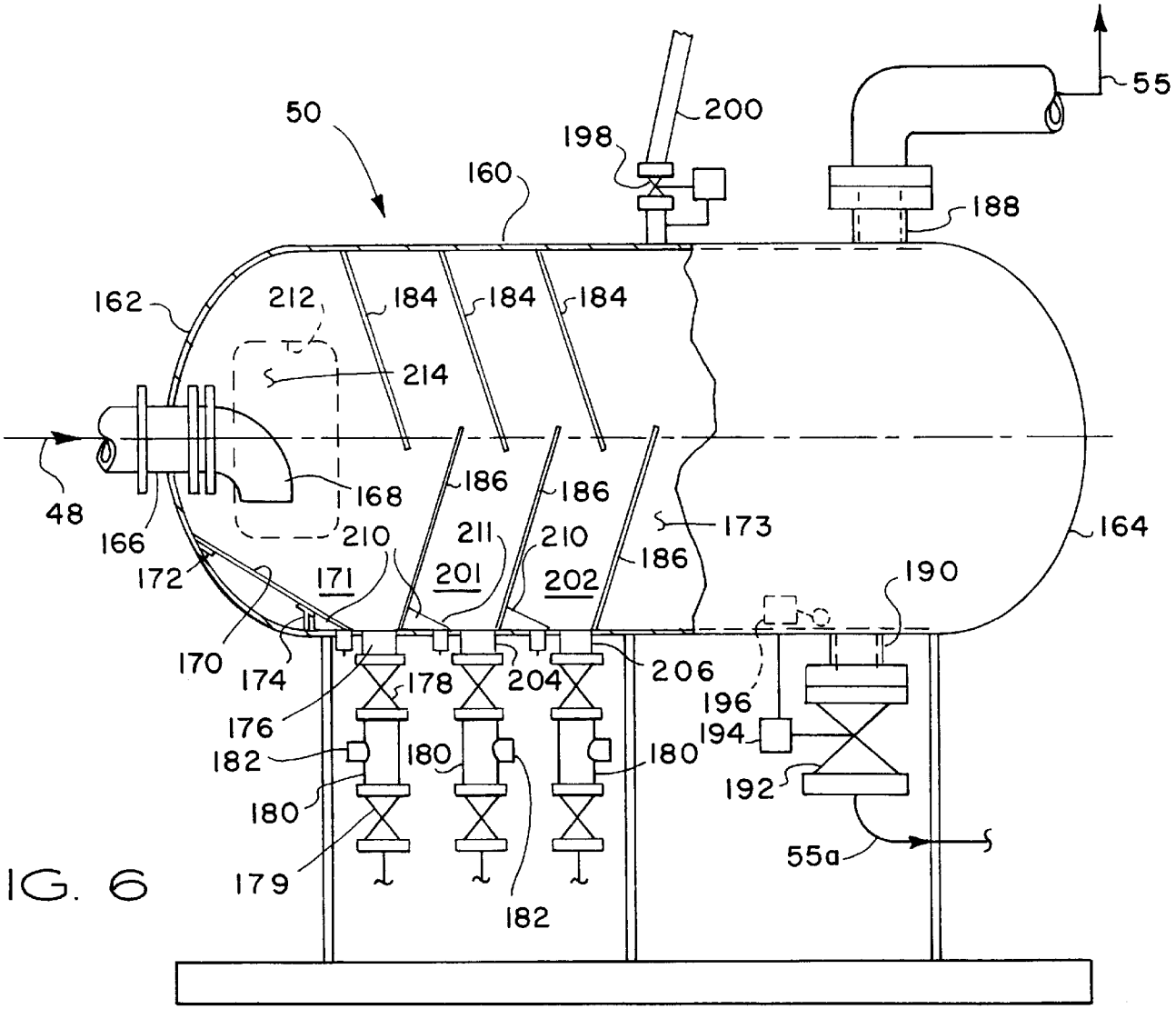
FIG. 6 is a side elevation, partially sectioned, and in somewhat schematic form, of a drill cuttings-drilling fluid separator apparatus in accordance with the invention.

Referring now to FIG. 6, the separator apparatus 50 is shown, partially sectioned and configured for operation with either of the systems described above. The apparatus 50 comprises a generally elongated cylindrical pressure vessel having a cylindrical sidewall 160 and opposed, somewhat hemispherical head portions 162 and 164 suitably welded to the sidewall 160 to form a closed high pressure vessel. The apparatus 50 includes a drill cuttings fluid inlet conduit 166 intersecting the head 162 and adapted to be connected to the conduit 48, as shown. The conduit 166 has a curved discharge end part 168 which directs the flow of cuttings laden drilling fluid onto a replaceable sloped wear plate 170 suitably removably disposed in the interior space 171 of the apparatus 50 and disposed on spaced apart supports 172 and 174, respectively. The plate 170 is sloped toward a discharge conduit section 176 connected to spaced apart valves 178 and 179 having a cuttings sampling conduit section 180 interposed therebetween and in communication with a valved pressure relief port and valve means 182 interposed therein for bleeding down gas pressure within conduit section 180.

A first series of baffles 184 is provided spaced apart from each other and extending downward and across the interior space 171 of the apparatus 50. A second series of spaced apart baffles 186 extend upward and form, with the baffles 184, a serpentine flow path between space 171 and a space 173 downstream of the last baffle 186 so that drilling fluid laden with cuttings and other substances entering the space 171 will, by way of substantial change in direction, cause a large portion of the solids drill cuttings, in particular, to separate from the fluid flowstream. The flowstream will progress through the serpentine flow path provided by the separator plates or baffles 184 and 186 to the space 173 where substantially solids free gas may then pass to conduit 55 by way of a discharge conduit section 188.

If the gas flowstream is also laden with formation liquids or injected foams, for example, it is likely that these fluids will separate out in the space 173 and collect within the space between a baffle 186 and the head 164. A discharge conduit 190 opens into the space 173 and is connected to a motor operated valve 192 whose motor operator 194 is connected to a suitable float or level control 196 disposed in the space 173. Accordingly, the apparatus 50 may operate automatically to discharge liquids and gaseous drilling fluid through valve 192 and conduit 55*a* when a particular level of liquid accumulates in space 173. A suitable relief valve 198 is also connected to the apparatus 50 and is operable to discharge fluid within the space 173 by way of a conduit 200 to a suitable reservoir or pit when an over pressure condition exists within the apparatus 50.

Since particulate solids will accumulate in the space 171 including the spaces 201 and 202 between the baffles or separator plates 186, second and third discharge conduits 204 and 206 open into these spaces and are connected to an arrangement of valves 178, 179 and sample collection conduits 180, respectively. Pressure bleed down port and valve means 182 are provided for the second and third conduits 180, respectively. Accordingly, cuttings collecting in the spaces 171, 201 and 202 may be periodically discharged into the conduits 180 by opening the valves 178, respectively, while valves 179 are maintained in a closed condition. After valves 178 are reclosed, valve means 182 may be operated to bleed down the pressure within the conduits 180 and then valves 179 may be opened to dump the contents of the conduits 180 for analysis of the drill cuttings and for transporting the drill cuttings in larger quantities away from the apparatus 50 for disposal. The valves 178, 179 and 182 may be automatically controlled to operate in sequence to provide for maintaining the spaces 171, 201 and 202 in a desired operating condition.

Moreover, suitable vibrator means 210 may be interposed in, mounted on an outside surface of or otherwise associated with the apparatus 50 and operated automatically, or at will. Each vibrator means 210 includes or is connected to a sloping solids discharge plate or surface 211, to cause particulate solids disposed in the spaces 171, 201 and 202 to flow into discharge conduits 176, 204 and 206, respectively, to facilitate emptying the spaces 171, 201 and 202 of solids particulates. The vibrator means 210 may be of a type commercially available. Access to the interior spaces 171, 201 and 202 may be obtained through a suitable port 212 in sidewall 160 and having cover means 214 removably secured thereover.

For the operating conditions described above, the pressure vessel of apparatus 50 may have an overall length of about 9.0 feet, a diameter of about 3.0 feet and be constructed as a pressure vessel to withstand the working gas pressures described hereinabove and using conventional engineering methods and materials for such pressure vessels. The replaceable wear plate 170 may be formed of a hardened material or have a particularly abrasion resistant coating disposed thereon to reduce the wear rate of the plate.

Figure 7:
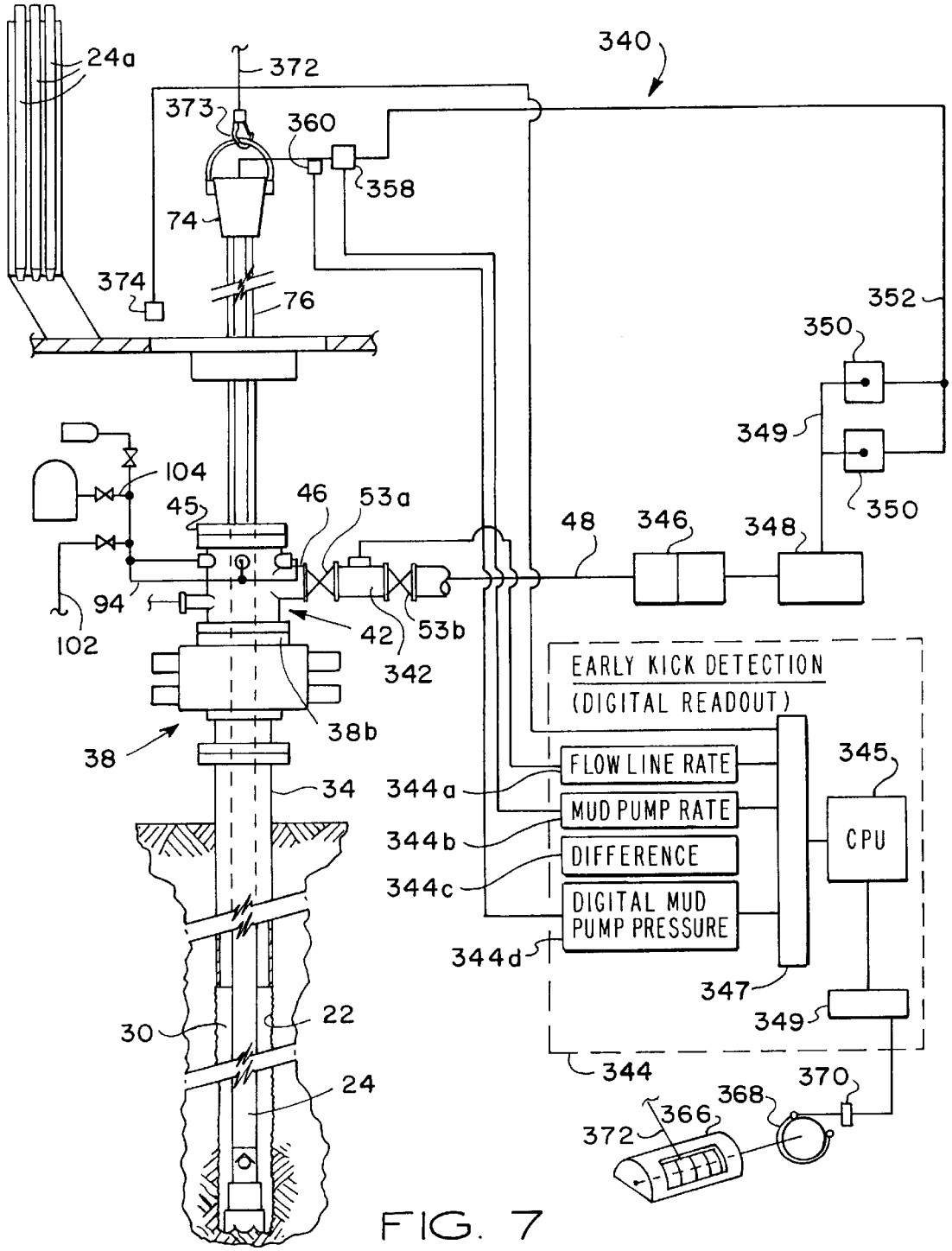
FIG. 7 is an elevation, in schematic form, of another drilling system in accordance with the present invention.

Referring now to FIG. 7, a drilling system 340 is illustrated which includes many of the components used in the drilling system 40 and which components are adapted, as required, for operation with a liquid drill cuttings evacuation fluid, such as a conventional drilling mud. In the drilling system 340, rotary control head 84 is not used and the enclosure 42 is operable to discharge cuttings laden drilling fluid through the branch conduit 46 and a suitable flowmeter 342 which is connected to a controller 344 for supplying suitable data, such as the rate of flow of drill cuttings laden fluid returning from a wellbore 22. The flowmeter 342 is preferably an electromagnetic type, such as available from Schlumberger Measurement Division, Greenwood, S.C., as one of their FLUMAG series meters. The conduit 48 is operable to discharge drilling fluid to a suitable cuttings separation apparatus or shale shaker 346 which discharges cuttings free drilling fluid to a storage tank or pit 348.

Drilling fluid is circulated from the pit or tank 348 by way of suitable pumps 350 connected to a fluid inlet manifold 349 and a fluid return flowline 352 whereby drilling fluid is circulated back through a swivel 74 and drillstem drive member 76 to drillstem 24 for circulation through bit 26 and up through annulus 30 to evacuate drill cuttings from the wellbore 22. A suitable flowmeter 358 is interposed in flowline 352 and a pressure sensor 360 is also interposed in the flowline 352, where indicated. Sensor 360 is preferably one of an electronic type commercially available and may be disposed in the so called standpipe portion of the line 352 at or near the base of the rig derrick. Sensor 360 may be connected to a visual readout device at the above mentioned standpipe location whereby the rig operating personnel may monitor pressure conditions continuously. The flowmeter 358 and the pressure sensor 360 are operable to transmit suitable signals to the controller 344 whereby the rate of fluid flow from the pumps 350 down through the drillstem 24 may be compared with the rate of flow of fluid leaving the wellbore 22 by way of the enclosure 42 as determined by the flowmeter 342. The controller 344 is operable to sense a predetermined change in pressure sensed by the sensor 360 and a predetermined difference in fluid flow rate measured by the flowmeters 342 and 358. If the fluid flow rate measured by the meter 342 differs from that measured by the meter 358 by a predetermined amount, a tendency for the well 22 to blowout or at least cause a so-called "kick" can be more accurately and earlier detected than by conventional measuring techniques and whereby the well can be controlled, at will.

The drilling system 340 also includes control means for controlling a brake on equipment such as a drawworks for hoisting and lowering the drillstem 24. As shown in FIG. 7, a schematic diagram of a conventional rotary drawworks 366 is illustrated having a conventional cable drum brake mechanism 368 which is operable to be controlled by an actuator 370 to apply braking forces to a hoist cable 372 which is connected to the swivel 74 in a conventional manner, including a swivel hook 373. When sectional drillstem members 24*a* are being added to a drill string during a "trip" into the wellbore 22, a counter 374 is operable to count the number of drillstem members or sections added to the drill string. The counter 374 may also be adapted to measure the length of each drillstem section counted or the stem section lengths may be determined. The number of drillstem sections and thus the length of drillstem being inserted in the wellbore is correlated with fluid pressure and flow rate measured in the flowline 48 by meter 342 and resulting from displacement of drilling fluid as the drillstem is lowered into the wellbore.

As sectional drillstem members 24*a* are being added to the drillstem 24 any increase in wellbore pressure resulting from inserting the drillstem further into the wellbore during, for example, a trip into the well after replacing the bit 26, may be controlled to minimize the rate of insertion of the drillstem into the wellbore to prevent the drilling fluid pressure in the annulus 30 from exceeding a predetermined amount. In this way, an underbalanced drilling condition of the well with a liquid drilling fluid or "mud" may be maintained and while avoiding excessive drilling fluid pressures which may cause penetration of drilling fluid into the formation interval of interest or into a lost circulation zone, and thereby also resulting in unwanted lowering of the hydrostatic pressure head in the wellbore. Accordingly, the pressure measured in the flowline 48, as well in the drillstem 24, may be monitored and if this pressure exceeds a predetermined "surge" value, braking action may be applied to the brake 368 of the drawworks 66 to minimize the rate of insertion of the drillstem 24 back into the wellbore 22.

Predetermined flowline rates, pump rates, and pressures may be entered into a suitable program operating on a digital computer or central processing unit (CPU) indicated by numeral 345 in FIG. 7. The CPU 345 may be connected to suitable interface circuits 347 and 349 for receiving control signals and for transmitting control signals to the actuator 370, respectively. Suitable visual readout devices 344*a*, 344*b*, 344*c* and 344*d* may be provided on controller 344 as shown.

Accordingly, improved methods may be carried out for operation of the drilling system 340 in an underbalanced pressure condition within the wellbore 22 by monitoring drilling fluid flow rate returning from the well as compared with the rate of drilling fluid pumped into the well. Any change in pumping pressure may also be monitored to provide a suitable alarm signal. Still further, during replacement of a drillstem in the well, fluid pressure in the well may be monitored and controlled to provide for a maximum pressure change as a result of displacement of drilling fluid in the wellbore during insertion of a drillstem therein.

Although preferred embodiments of the present invention have been described in detail herein, those skilled in the art will recognize that various substitutions and modifications may be made to the invention without departing from the scope and spirit of the appended claims.

What is claimed is:

1. In a system for drilling a well into a subterranean earth formation, said system including an elongated drillstem extendable into a wellbore penetrating said earth formation, a rotary seal for said drillstem, and means forming a circulation path for drill cuttings evacuation fluid circulated through said drillstem and through an annulus of said wellbore formed between a wellbore wall and said drillstem, the improvement characterized by:

a member disposed in said circulation path between said rotary seal and said wellbore comprising a generally cylindrical main conduit section including an interior wall and forming an enclosure, a branch conduit section intersecting said main conduit section for conducting cuttings laden evacuation fluid away from said main conduit section and means for connecting said main conduit section to said rotary seal;

plural nozzles in said main conduit section between said branch conduit section and said rotary seal and inclined with respect to said interior wall of said main conduit section in a direction to discharge fire extinguishing fluid into said main conduit section and toward said rotary seal; and a source of fire extinguishing fluid operably connected to said nozzles for discharging fire extinguishing fluid into the flow path of cuttings laden evacuation fluid to suppress combustion of combustible materials in said evacuation fluid.

2. The improvement set forth in claim 1 wherein:

said nozzles are disposed spaced apart from each other about a circumference of said main conduit section, and operably connected to said source of fire extinguishing fluid for injecting said fire extinguishing fluid into the interior of said main conduit section.

3. The improvement set forth in claim 2 including:

a manifold connected to said source of fire extinguishing fluid and to said nozzles for discharging fire extinguishing fluid from a reservoir of fire extinguishing fluid to said manifold.

4. The improvement set forth in claim 3 including:

a conduit interconnecting said reservoir and said manifold and another conduit interconnecting a source of water with said manifold and control valve means interposed in said conduits, respectively.

5. The improvement set forth in claim 1 wherein:

said main conduit section includes a restabbing flange at one end thereof.

6. The improvement set forth in claim 1 wherein:

at least one of the fluid flow capacity of said nozzles and the quantity of fluid available from said source are based on parameters selected from a group consisting of the expected quantity of fluid flowing from said well, the velocity profile of well stream fluid components emanating from said well, an impingement arc of a blowing well stream against structure adjacent a wellhead of said well, the combustion profile of said components of said well stream that are likely to be burning in said impingement arc, and the temperature profile of said well stream if burning.

7. In a system for drilling a well into a subterranean earth formation including an elongated drillstem extendable into a wellbore, said wellbore including a wellhead through which said drillstem extends, a closed gaseous drilling fluid circulation system comprising:

an enclosure operably connected to said wellhead for receiving cuttings laden gaseous drilling fluid from said wellbore;

a control head operably connected to said wellhead for receiving a portion of said drillstem and for forming a substantially fluid tight seal therewith to prevent escape of drilling fluid from said system; and a pressure vessel operably connected to said enclosure for receiving cuttings laden drilling fluid from said enclosure, said pressure vessel including an interior space for receiving cuttings laden drilling fluid therein and for separating a substantial portion of drill cuttings solids from said drilling fluid, said pressure vessel including means for discharging substantially cuttings free drilling fluid from said pressure vessel, means for discharging drill cuttings from said pressure vessel from time to time without releasing a substantial quantity of drilling fluid from said pressure vessel to atmosphere, a liquid collection space for receiving liquids entrained with said drilling fluid, discharge port means in communication with said liquid collection space for receiving liquid and drilling fluid and control means for discharging liquid and drilling fluid from said liquid collection space in response to accumulation of a predetermined quantity of liquid in said liquid collection space.

8. The system set forth in claim 7 wherein:

said means for discharging drill cuttings from said pressure vessel comprises a discharge conduit, and valve means interposed in said discharge conduit for allowing a quantity of drill cuttings to pass through said discharge conduit without discharging a substantial quantity of drilling fluid from said pressure vessel.

9. The system set forth in claim 7 including:

pressure relief valve means operably connected to said pressure vessel and to a discharge conduit for discharging pressure fluid from said pressure vessel.

10. The system set forth in claim 7 including:

separator means connected to said pressure vessel for receiving drilling fluid therefrom and for separating at least one of solids and liquids from drilling fluid exiting said pressure vessel.

11. A method for drilling a well into a subterranean earth formation with a drilling system including an elongated drillstem extendable into a wellbore, means for conducting natural gas drill cuttings evacuation fluid through said drillstem into a wellbore annulus formed between said wellbore and said drillstem and means for removing drill cuttings from said drill cuttings evacuation fluid leaving said wellbore, comprising the steps of:

providing evacuation fluid from a pressure gas conduit connected to one of a gas reservoir, a gas gathering conduit system, and a gas conduit delivery system;

circulating said evacuation fluid through said wellbore to entrain drill cuttings therein;

separating drill cuttings from said evacuation fluid; and discharging cuttings free evacuation fluid to a gas distribution conduit.

12. The method set forth in claim 11 including the steps of:

compressing said evacuation fluid prior to circulating said evacuation fluid through said wellbore, and separating liquids from said evacuation fluid prior to compression of said evacuation fluid.

13. The method set forth in claim 11 including the step of:

maintaining the pressure of said evacuation fluid in said wellbore at a pressure less than the natural pressure in said formation during drilling of said well.

14. The method set forth in claim 11 including the step of:

maintaining the pressure of said evacuation fluid in said wellbore at a pressure greater than the pressure in said formation.

15. In a system for drilling a well into a subterranean earth formation:

an elongated drillstem extendable into a wellbore forming said well and operable to conduct a gaseous drill cuttings evacuation fluid into said wellbore for evacuating drill cuttings therefrom;

a wellhead including means forming a seal at said drillstem and an enclosure forming a fluid conducting interior space disposed around said drillstem, said enclosure including a discharge conduit for conducting drill cuttings evacuation fluid from said wellbore through said enclosure;

a pressure vessel connected to said discharge conduit including means therein for separating particulate solids drill cuttings from gaseous drill cuttings evacuation fluid;

compressor means operable for discharging pressure gaseous drill cuttings evacuation fluid to said wellbore;

conduit means interconnecting said compressor means with said pressure vessel for conducting substantially solids free drill cuttings evacuation fluid to said compressor means; and a fine particle separator device interposed said pressure vessel and said compressor means for separating fine particulate solids from said drill cuttings evacuation fluid.

16. In a system for drilling a well into a subterranean earth formation:

an elongated drillstem extendable into a wellbore forming said well and operable to conduct a gaseous drill cuttings evacuation fluid into said wellbore for evacuating drill cuttings therefrom;

a wellhead including means forming a seal at said drillstem and an enclosure forming a fluid conducting interior space disposed around said drillstem, said enclosure including a discharge conduit for conducting drill cuttings evacuation fluid from said wellbore through said enclosure;

a pressure vessel connected to said discharge conduit including means therein for separating particulate solids drill cuttings from gaseous drill cuttings evacuation fluid;

compressor means operable for discharging pressure gaseous drill cuttings evacuation fluid to said wellbore;

conduit means interconnecting said compressor means with said pressure vessel for conducting substantially solids free drill cuttings evacuation fluid to said compressor means; and gas-liquid separator means disposed in said drilling system between said pressure vessel and said compressor means.

17. In a system for drilling a well into a subterranean earth formation:

an elongated drillstem extendable into a wellbore forming said well and operable to conduct a gaseous drill cutting evacuation fluid into said wellbore for evacuating drill cuttings therefrom;

a wellhead including means forming a seal at said drillstem and comprising a rotary control head forming a substantially fluid tight seal around a section of said drillstem to prevent flow of said drill cuttings evacuation fluid from said drilling system and an enclosure forming a fluid conducting interior space disposed around said drillstem and operably connected to said control head, said enclosure including a discharge conduit for conducting drill cuttings evacuation fluid from said wellbore through said enclosure;

a pressure vessel connected to said discharge conduit including means therein for separating particulate solids drill cuttings from gaseous drill cuttings evacuation fluid;

compressor means operable for discharging pressure gaseous drill cuttings evacuation fluid to said wellbore;

a source of fluidizable fire extinguishing material; and fluid discharge nozzle means operable to inject fire extinguishing fluid into said interior space to minimize the ignition of said drill cuttings evacuation fluid in a region of said drilling system near said control head.

18. The drilling system set forth in claim 17 including:

manifold means interconnecting said source fluidizable fire extinguishing material with a plurality of fluid discharge nozzles for discharging fluidized fire extinguishing material into said enclosure.

19. The drilling system set forth in claim 17 wherein:

said drill cuttings evacuation fluid comprises natural gas.

20. In a system for drilling a well into a subterranean earth formation including an elongated drillstem extendable into a wellbore, said wellbore including a wellhead through which said drillstem extends, a closed gaseous drilling fluid circulation system comprising:

an enclosure operably connected to said wellhead for receiving cuttings laden gaseous drilling fluid from said wellbore;

a control head operably connected to said wellhead for receiving a portion of said drillstem and for forming a substantially fluid tight seal therewith to prevent escape of drilling fluid from said system; and a pressure vessel operably connected to said enclosure for receiving cuttings laden drilling fluid from said enclosure, said pressure vessel including an interior space for receiving cuttings laden drilling fluid therein and for separating a substantial portion of drill cuttings solids from said drilling fluid, said pressure vessel including means for discharging substantially cuttings free drilling fluid from said pressure vessel, a plurality of spaced apart baffles disposed in said pressure vessel and forming separate interior spaces therebetween and within said pressure vessel, and means for discharging drill cuttings from said pressure vessel from time to time comprising a discharge conduit in communication with each of said spaces and valve means interposed in said discharge conduits for allowing a quantity of drill cuttings to pass through said discharge conduits without discharging a substantial quantity of drilling fluid from said pressure vessel to atmosphere.

21. The system set forth in claim 20 including:

vibrator means disposed in said interior spaces, respectively, for effecting movement of drill cuttings residing in said interior spaces toward said discharge conduits, respectively.

22. In a system for drilling a well into a subterranean earth formation including an elongated drillstem extendable into a wellbore, said wellbore including a wellhead through which said drillstem extends, a closed gaseous drilling fluid circulation system comprising:

an enclosure operably connected to said wellhead for receiving cuttings laden gaseous drilling fluid from said wellbore;

a control head operably connected to said wellhead for receiving a portion of said drillstem and for forming a substantially fluid tight seal therewith to prevent escape of drilling fluid from said system; and a pressure vessel operably connected to said enclosure and including an inlet conduit in communication with said enclosure for receiving cuttings laden drilling fluid from said enclosure, said pressure vessel including an interior space for receiving cuttings laden drilling fluid therein and for separating a substantial portion of drill cuttings solids from said drilling fluid, a removable wear plate disposed in said interior space, said inlet conduit being directed at said wear plate, access port means formed in said pressure vessel for access to said interior space, said pressure vessel including means for discharging substantially cuttings free drilling fluid from said pressure vessel and means for discharging drill cuttings from said pressure vessel from time to time without releasing a substantial quantity of drilling fluid from said pressure vessel to atmosphere.

23. In a system for drilling a well into a subterranean earth formation including an elongated drillstem extendable into a wellbore, said wellbore including a wellhead through which said drillstem extends, a closed gaseous drilling fluid circulation system comprising:

an enclosure operably connected to said wellhead for receiving cuttings laden gaseous drilling fluid from said wellbore;

a control head operably connected to said wellhead for receiving a portion of said drillstem and for forming a substantially fluid tight seal therewith to prevent escape of drilling fluid from said system;

a pressure vessel operably connected to said enclosure for receiving cuttings laden drilling fluid from said enclosure, said pressure vessel including an interior space for receiving cuttings laden drilling fluid therein and for separating a substantial portion of drill cuttings solids from said drilling fluid, said pressure vessel including means for discharging substantially cuttings free drilling fluid from said pressure vessel and means for discharging drill cuttings from said pressure vessel from time to time without releasing a substantial quantity of drilling fluid from said pressure vessel to atmosphere;

separator means disposed between said enclosure and said pressure vessel for separating solids particulates and gaseous drilling fluid from liquids entrained with said drilling fluid; and conduit means interconnecting said separator means with said pressure vessel for conducting drilling fluid to said pressure vessel.

24. The system set forth in claim 23 including:

compressor means for circulating said drilling fluid to said wellbore and conduit means connected to said pressure vessel for conducting substantially solids free drilling fluid to said compressor means.

25. The system set forth in claim 24 including:

gas-liquid separator means connected to said first mentioned separator means for separating gaseous drilling fluid from liquids entrained therein from said formation; and conduit means connected to said gas-liquid separator means and to said compressor means.

26. In a system for drilling a well into a subterranean earth formation, said system including an elongated drillstem extendable into a wellbore penetrating said earth formation and a wellhead operably connected to said wellbore for receiving said drillstem extending therethrough and including means forming a circulation path for drill cuttings evacuation fluid circulated through said drillstem and through an annulus of said wellbore formed between a wellbore wall and said drillstem, the improvement characterized by:

a member forming a substantially tubular enclosure supported on said wellhead and disposed in said circulation path comprising a generally cylindrical main conduit section and branch conduit section intersecting said main conduit section for conducting cuttings laden evacuation fluid away from said main conduit section;

an array of nozzles on said member and opening into an interior space formed by said main conduit section, said nozzles being in fluid flow communication which said main conduit section at a point above said branch conduit section and below further well structure, said nozzles being inclined at an acute angle with respect to an interior wall of said main conduit section in a direction toward said further well structure and in a direction of flow of cuttings evacuation fluid and wellbore fluids in the event of uncontrolled flow of fluids from said wellbore through said main conduit section and past said branch conduit section;

a manifold connected to each of said nozzles; and a source of fire extinguishing fluid operably connected to said manifold for discharging said fire extinguishing fluid into the flow path of wellbore fluids flowing through said main conduit section without diversion into said branch conduit section to suppress combustion of such wellbore fluids.

27. The improvement set forth in claim 26 wherein:

said manifold comprises a single arcuate manifold disposed about and spaced from said main conduit section and connected to respective manifold conduits in communication with said nozzles, respectively.

28. The improvement set forth in claim 27 including:

respective block valves disposed in said manifold conduits between said manifold and said nozzles, respectively, for shutting off flow between said nozzles and said manifold.

29. The improvement set forth in claim 27 wherein:

said manifold is connected at one point to a source of a fluidized fire extinguishing material and said manifold is connected at another point to a separate source of pressure water.

30. The improvement set forth in claim 26 wherein:

said nozzles are convergent nozzles which intersect said interior wall of said main conduit section for injecting fire extinguishing fluid toward said further well structure.

31. The improvement set forth in claim 30 wherein:

said nozzles intersect said interior wall at an angle of about 30°.

32. The improvement set forth in claim 26 including:

a restabbing flange on said member between said nozzles and said further well structure.

33. In a system for drilling a well into a subterranean earth formation, said system including an elongated drillstem extendable into a wellbore penetrating said earth formation, a wellhead operably connected to said wellbore and means mounted on said wellhead and operable to form a substantially fluid tight seal around said drillstem to prevent wellbore fluids from being discharged from said wellhead along the exterior of said drillstem, the improvement characterized by:

a member disposed on said wellhead and supporting said means forming said seal, said member including a generally cylindrical main conduit section forming an enclosure and a branch conduit section intersecting said main conduit section for conducting wellbore fluids away from said wellhead at a point between said wellbore and said means forming said seal;

a plurality of nozzles spaced apart circumferentially about said main conduit section and in communication with an interior space of said main conduit section between said branch conduit section and said means forming said seal, said nozzles being oriented in direction inclined with respect to an interior wall of said main conduit section for directing a flow of fire extinguishing fluid toward said means forming said seal and in the direction of flow of fluids from said wellbore through said main conduit section in the event of failure of said means forming said seal; and a source of fire extinguishing fluid operably connected to said nozzles for discharging fire extinguishing fluid into said main conduit section to suppress combustion of combustible materials flowing from said wellbore.

* * * * *